United States Patent [19]

Kim

[11] Patent Number: 5,043,709

[45] Date of Patent: Aug. 27, 1991

[54] JOYSTICK FOR USE WITH VIDEO GAMES AND THE LIKE

[76] Inventor: Samuel S. Kim, 3820 N. Charlemagne Dr., Hoffman Estates, Ill. 60195

[21] Appl. No.: 434,719

[22] Filed: Nov. 13, 1989

[51] Int. Cl.[5] ..... G09G 3/02

[52] U.S. Cl. ..... 340/709; 200/6 A

[58] Field of Search ..... 340/709, 706; 200/6 A; 273/148 B

[56] References Cited

U.S. PATENT DOCUMENTS

| | | | |
|---|---|---|---|
| 4,439,648 | 3/1984 | Sledesky et al. | 200/6 A |
| 4,470,320 | 9/1984 | Kim | 200/6 A |
| 4,473,725 | 9/1984 | Kim | 200/6 A |
| 4,488,017 | 12/1984 | Lee | 340/709 |

*Primary Examiner*—Alvin E. Oberley
*Assistant Examiner*—Xiao Min Wu
*Attorney, Agent, or Firm*—Laff, Whitesel, Conte & Saret

[57] ABSTRACT

A joystick device to be used in video games or the like having an improved construction to prolong the life of the switches used in the joystick device. The improved construction includes a conical spring located between a diaphragm and an actuator which reduces the force ultimately applied to the switches by the user of the video game. The actuator and the diaphragm surround portions of the shaft, and the actuator has a tapered inner wall which allows pivotal movement of the shaft which further reduces the force ultimately applied to the switches.

12 Claims, 2 Drawing Sheets

JOYSTICK FOR USE WITH VIDEO GAMES AND THE LIKE

The present invention is directed to a joystick device, and more particularly to a joystick device used with electronic instruments such as video games or the like, which device is adapted to affect or activate activity on the video screen and which has an improved construction which prolongs its useful life.

It has been heretofore known to use joystick devices in video games or the like. These prior art joystick devices usually include a plurality of contact switches, each of which can be activated upon manipulation of the joystick shaft. The specific switch activated depends upon the direction in which the joystick shaft is manipulated. The joystick shaft is pivotally mounted to a base portion which houses the contact switches, and a switch actuator is attached to the shaft. In operation, the manipulation of the shaft causes the shaft and the actuator to move together, whereby the actuator contacts and thereby activates the switch. The activated switch causes activity or affects activity on the video screen. One of the problems with the prior art joysticks is that the switch receives the full force applied by the user to the shaft, which has a tendency to shorten the useful life of the switch.

Both contact switches and Mylar switches have been used in combination with prior art joysticks. One of the problems associated with the contact switch is that dirt or the like tends to collect within the gap between the contacts. Because the dirt affects the operability of the switch, either the dirt must be removed or the switch must be replaced. Also, after prolonged use, the gap in a contact switch begins to open by itself. This is a difficult situation to correct, since if the contacts of the switch are calibrated too close to each other, the contacts tend to close by themselves. If the contacts are set too far apart, the switch loses its sensitivity. The problem associated with the Mylar switch used in the prior art is that its useful life is relatively short, particularly when subjected to repeated, heavy impact.

The useful life of a Mylar switch is an important factor in manufacturing a joystick control for a video arcade game which incorporates such switches. The switch includes contacts inside an enclosed, pliable sheath, which must be able to spring back after each closure. Presently available technology enables Mylar switches to be used for video arcade games, in view of the longer spring life attributable to these switches. It is widely recognized that joystick devices in arcade video games are subject to substantial repeated impact forces by the user.

Mylar switches are presently designed with a useful life of 10,000,000 cycles. However, with the abuse such a switch receives in a coin-operated arcade game, Mylar switches cannot meet these requirements. For each cycle of operation, the switch loses a slight amount of tension. The rate of tension loss is greatly exacerbated when the full force of the joystick shaft as applied by the player is applied to the switch. This loss of tension can be greatly reduced if a resilient element, such as a spring, absorbs a majority of the force applied by the user, and the total manual force is not applied directly to the switch.

Accordingly, it is an object of the present invention to provide a new and improved joystick device which has a longer useful life compared to joystick devices heretofore known.

Another object of the invention is to provide a joystick device which incorporates a resilient connection between the joystick shaft and the switch actuator to reduce the impact force of the switches. The resilient connection in the preferred embodiment comprises a spring which surrounds a portion of the joystick and absorbs some of the force applied by the joystick to the actuator, thus reducing the force applied to the switch and extending the life of the switch.

Another object of the present invention is to provide a new and improved joystick device incorporating a resilient connection between the joystick shaft and the switch actuator, wherein the actuator portion through which the joystick shaft extends includes a tapered inner wall which further reduces the amount of force transferred to the actuator and the switches to further prolong the useful life of the switches.

Another object of the present invention is to provide a joystick device including a joystick shaft resiliently connected to an actuator and switches adapted to be activated by the actuator, wherein the actuator moves independent of, yet responsive to, the control of the joystick shaft.

The above objects are accomplished by providing a joystick assembly including a joystick shaft pivotally mounted in a housing, a plurality of switches in the housing, and an actuator resiliently mounted to the joystick shaft and adapted to selectively contact and activate the switches. The actuator bears on the switches with a force regulated by the resilient connection, and not by the full force acting on the handle, thus lessening the wear of the switches. The travel of the actuator is also limited by the resilient connection. An aperture in the actuator through which the joystick shaft extends is tapered to allow the actuator free pivotal movement relative to the joystick shaft. By regulating the characteristics of the resilient connection, the pressure applied to the switches can be controlled to a desired level.

A preferred embodiment of the invention is shown in the attached drawing, wherein.

Figure 1:
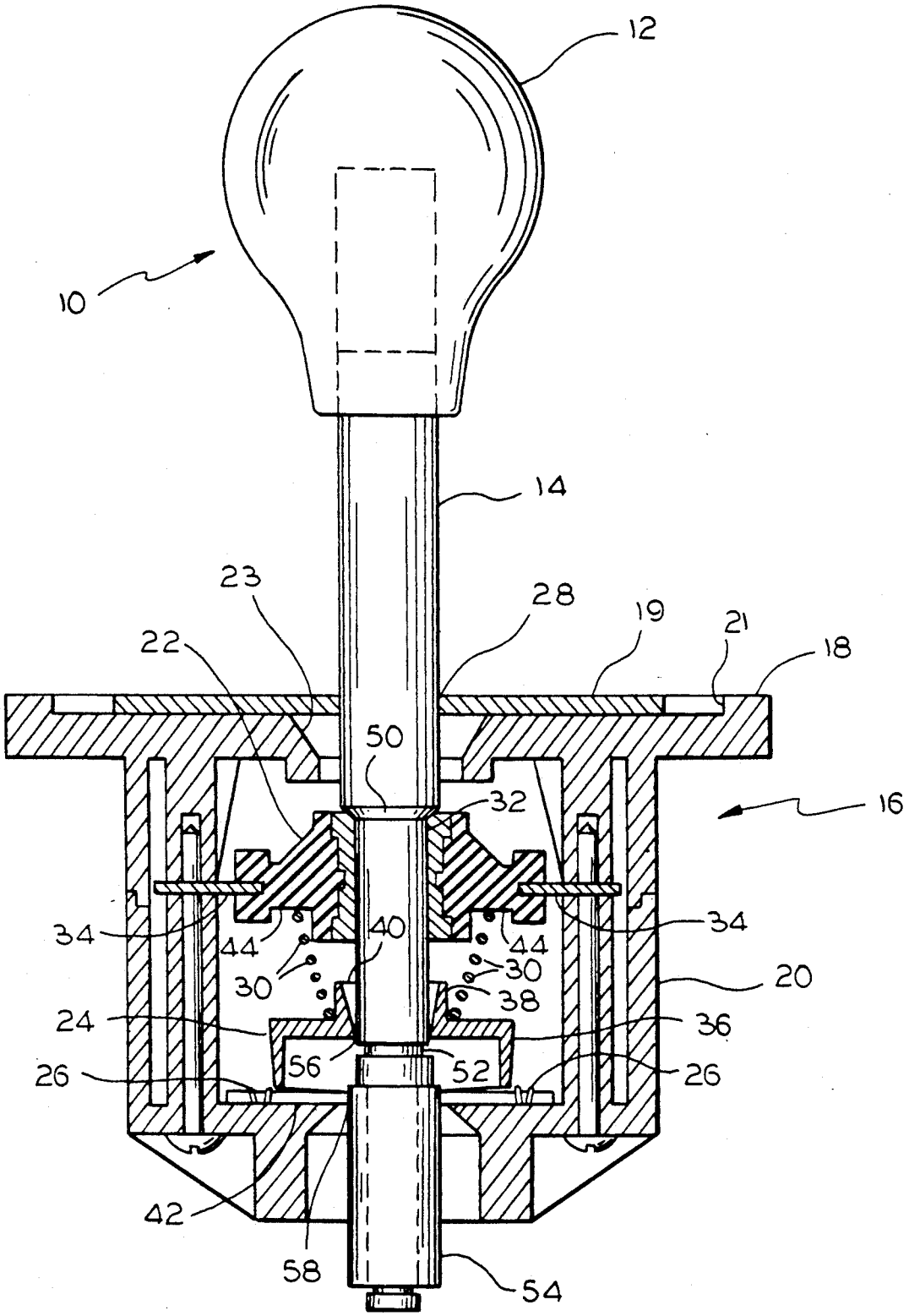
FIG. 1 is a longitudinal view of the joystick device in accordance with the preferred embodiment of the invention showing a section view of the housing and elements of the device in the housing.

In FIG. 1, a joystick device 10 is shown which generally comprises a handle 12, a shaft 14 and a housing 16. The handle, shaft and housing may be constructed of metal, hard plastic or any other suitable material.

Housing 16 generally comprises an upper flanged portion 18 and a hollow base 20, and houses a diaphragm 22, an actuator 24, a resilient element or spring 30 and a plurality of switches 26. Cover 19 is disposed in a circular cut-away portion 21 of flanged potion 18 and includes an aperture 28 which receives shaft 14. Flange portion 18 includes a wider aperture 23 which may be tapered to allow increased pivotal movement of shaft 14 which shaft extends through aperture 23. Flange portion 18 may also include plurality of fastening holes not shown which can be used to fasten the joystick device to the playing deck of a video game.

Diaphragm 22 includes a aperture 32 through which shaft 14 extends and surrounds a portion of shaft 14 within housing 16. Shaft 14 is firmly attached to diaphragm 22. Diaphragm 22 is attached to the side walls of base 20 of the housing by plates 34, preferably made of a resilient material, for purposes to be explained. Actuator 24 is an inverted cup-shaped element which surrounds another portion of shaft 14 within the housing 16, and is generally comprised of a hollow cylindrical base portion 36 and an upper smaller cylindrical portion 38 which is integral with base 36. Cylindrical base portion 36 is adapted to contact the switches 26 upon movement of the actuator, as will be explained. The upper cylindrical portion 38 of actuator 24 includes an aperture 40 to receive shaft 14, which aperture 40 is tapered to allow increased pivotal movement of shaft 14 relative to the actuator 24. Actuator 24 is mounted loosely on shaft 14, and is not directly connected to the shaft.

Figure 3:
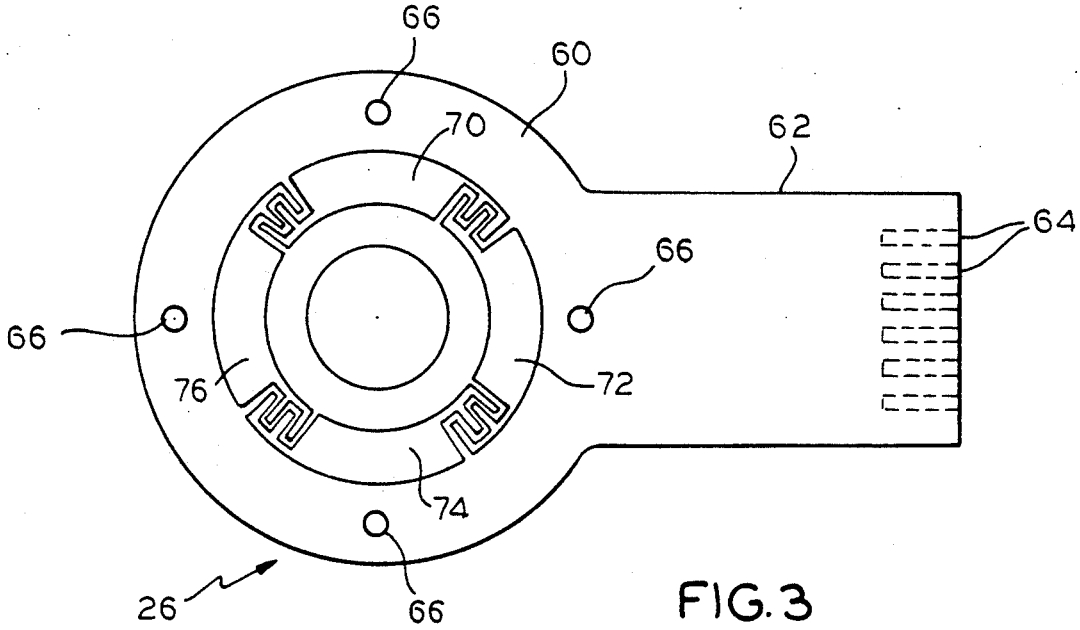
FIG. 3 is a top view of a mylar switch used in accordance with the joystick device of FIG. 1.

In the preferred embodiment, switch 26 is a mylar switch as shown in FIG. 3, which comprises a reed switch fully enclosed between two sheets of mylar. This design prevents dirt from coming in contact with the reed switch. The switches are located at bottom 42 of base 20 and immediately adjacent to the cylindrical base portion 36 of actuator 24. Downward pressure applied by actuator 24 activates one or more of switches 26, while upward pressure deactivates the switch or switches. The switches are electronically attached to the video game and are adapted to initiate or affect activity on the video screen upon activation. Preferably, there are either four or eight switches included, each switch being capable of initiating different action on the video screen.

Spring 30, which is preferably a conical spring, is enclosed within housing 16, and surrounds a portion of shaft 14. Spring 30 extends from an annular recess 44 of diaphragm 22 to an area on the top of actuator 24 adjacent portion 38 and the tapered walls of aperture 40. The wider end of the conical spring is located at the annular recess.

Figure 2:
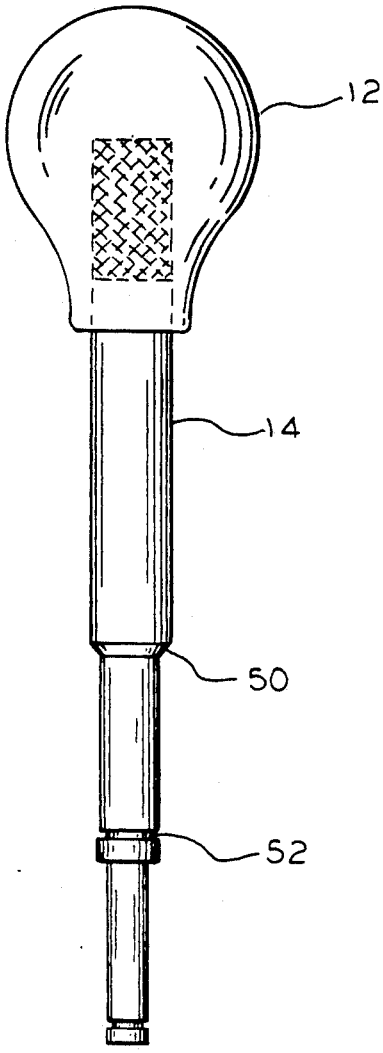
FIG. 2 is a longitudinal view of the shaft of the joystick of FIG. 1.

As shown in FIGS. 1 and 2, the preferred structure of shaft 14 is an integral structure which tapers at location 50, where it is surrounded by diaphragm 22, and at location 52, where it is surrounded by a sleeve 54.

Sleeve 54 is rotatably mounted at the lower end of shaft 14 where the shaft extends through the center axis of switches 26 and out of the bottom of housing base 20 through a tapered aperture 58. As shaft 14 moves pivotally about point 56 upon application of a lateral force or forces on handle 12 of shaft 14, the lower portion of shaft 14 correspondingly shifts laterally, and comes into contact with one of the walls of aperture 58, the walls of which define the stop portion or limits of lateral movement of shaft 14 when a force is applied. Sleeve 54 presents frictional contact between shaft 14 and the walls of aperture 58 permit the lower end of shaft 14 to frictionlessly roll around aperture 58 when such contact is made, thus preventing the lower part of shaft 14 from wearing out. A suitable washer holds sleeve 54 onto the end of shaft 14.

In operation, joystick device 10 is attached structurally and connected electronically to the operating deck of a video game or the like. The user of the video game grips handle 12 and, by applying a lateral force, can move the shaft in any lateral direction, tilting the shaft about pivot point 56 through 360°. The movement of shaft 14 causes diaphragm 22 to move laterally and in a slight downward arc with point 56 as a fulcrum. This downward component of movement exerts a force upon spring 30, causing the spring to transfer the force to the portion of actuator 24 below the downwardly deflected segment of diaphragm 22. This causes the actuator to move downward at that portion and to contact and thereby activate one of the switches 26 which corresponds to the direction of the shaft movement. As diaphragm 22 moves laterally and in its slight arc, resilient plates 34 deflect and urge diaphragm 22 back to its original position after the force on handle 12 and shaft 14 is relieved. The tapered walls of aperture 40 of the actuator allow pivotal movement of shaft 14 about point 56 and relative to actuator 24. Accordingly, as a result of the tapered walls of the actuator and the resiliency of the spring, the force applied to the activated switch 26 is that of spring 30, which is significantly less than the manual force applied by the user to shaft 14. This application of a reduced force substantially prolongs the useful life of the switches 26, since the spring 30 absorbs the shock of the manual force. The spring force also limits the travel of the actuator, which adds to the useful life of the joystick structure 10.

FIG. 3 is representative of a typical form of Mylar switch pad 26 which is utilized in the control apparatus of arcade electronic games. The switch 26 comprises a base assembly 60 having a protruding portion 62 which terminates in a plurality of contacts 64. Apertures 66 are provided to attach base assembly 60 to the lower portion of housing base 20, as seen in FIG. 1. Electric wires (not shown) extend from contacts 64 to the electronic instrument, such as an arcade video game, which joystick device 10 is adapted to control.

Mounted on base assembly 60 of switch pad 26 are four separate Mylar switches 70, 72, 74, 76, each adapted to complete an electric circuit through one or more contacts 64. In the illustrated embodiment, four switch segments are shown, however, any desired number of switches may be utilized. Actuator 24 engages the switches 70, 72, 74, or 76 in the direction of application of the lateral force to shaft 14. The ends of each of switches 70, 72, 74 and 76 dovetail into the adjacent switch, enabling actuator 24 to activate two switches at a time when forced by the shaft 14 in the direction of the overlapping switch ends.

Those who are skilled in the art will readily perceive how to modify the invention. Therefore, the appended claims are to be construed to cover all equivalent structures which fall within the true scope and spirit of the invention.

I claim:

1. A joystick device comprising:

a shaft;

a housing adapted to receive said shaft;

flexible means mounting said shaft to said housing permitting partial pivotal movement of said shaft with respect to said housing upon application of lateral force to said shaft;

switch means disposed in said housing and actuator means in said housing disposed adjacent said switch means whereby said switch means are selectively activated or de-activated responsive to movement of said actuator means; and resilient force means operatively extending between said shaft and said actuator means to apply a force to the actuator means upon pivotal movement of said shaft and to absorb a portion of the lateral force applied to said shaft;

wherein said actuator means surrounds a portion of said shaft in said housing and includes an aperture through which a portion of said shaft extends, said aperture being tapered in the axial direction to permit pivotal movement of said shaft in said housing free of interference from said actuator means.

2. The joystick of claim 1 wherein the application of said lateral force to said shaft creates a relatively small component of force directed to said resilient force means, said component of force being transferred to said actuator means by said resilient force means.

3. The joystick of claim 1 wherein a radially extending diaphragm means is rigidly fixed to said shaft and is connected to said flexible means, whereby said resilient force means extends between said diaphragm means and said actuator means.

4. The joystick device of claim 3 wherein said resilient force means is a conical spring having a wide end in contact with said diaphragm means and a relatively smaller end in contact with said actuator means.

5. The joystick device of claim 1 wherein said actuator means comprises a cylindrical base portion adapted to selectively contact said switch means and an upper cylindrical portion through which said tapered aperture extends.

6. The joystick device of claim 1 wherein said housing comprises an upper flanged portion and a lower base portion, said upper flanged portion including an aperture having a tapered inner wall, said shaft extending through said aperture.

7. The joystick device of claim 1 wherein said switch means comprises a plurality of separately operable switch elements, each adapted to be activated upon contact with said actuator responsive to a separate direction of movement of said shaft.

8. The joystick device of claim 1 wherein said shaft includes a bottom portion which extends through a base portion of said housing, and sleeve means rotatably mounted on the bottom portion of said shaft to provide a frictionless bearing surface between said bottom portion of said shaft and said housing.

9. The joystick of claim 8 wherein said base portion of said housing includes a tapered aperture through which said bottom portion of said shaft extends, said sleeve means adapted to abut said tapered aperture to define the lateral limits of pivotal movement of said shaft upon application of said lateral force to said shaft.

10. The combination of a joystick device adapted to activate an electronic instrument, said joystick device comprising:

a shaft;

a housing adapted to receive said shaft;

flexible means mounting said shaft to said housing permitting partial pivotal movement of said shaft with respect to said housing upon application of lateral force to said shaft;

switch means disposed in said housing electrically connected to said electronic instrument, whereby selective activation and de-activation of said switch means controls the operation of said electronic instrument;

actuator means in said housing disposed adjacent said switch means, whereby said switch means are selectively activated or de-activated responsive to movement of said actuator means; and resilient force means operatively extending between said shaft and said actuator means to apply a force to the actuator means upon pivotal movement of said shaft and to absorb a portion of the lateral force applied to said shaft;

wherein said actuator means surrounds a portion of said shaft in said housing and includes an aperture through which a portion of said shaft extends, said aperture being tapered in the axial direction to permit pivotal movement of said shaft in said housing free of interference from said actuator means.

11. A joystick device comprising:

a shaft;

a housing adapted to receive said shaft;

flexible means mounting said shaft to said housing permitting partial pivotal movement of said shaft with respect to said housing upon application of lateral force to said shaft;

switch means disposed in said housing and actuator means in said housing disposed adjacent said switch means whereby said switch means are selectively activated or de-activated responsive to movement of said actuator means; and resilient force means operatively extending between said shaft and said actuator means to apply a force to the actuator means upon pivotal movement of said shaft and to absorb a portion of the lateral force applied to said shaft;

wherein said actuator means comprises a cylindrical base portion and an upper cylindrical portion and wherein a portion of said resilient force means surrounds said upper cylindrical base portion;

wherein said actuator means surrounds a portion of said shaft in said housing and includes an aperture through which a portion of said shaft extends, said aperture being tapered in the axial direction to permit pivotal movement of said shaft in said housing free of interference from said actuator means.

12. The joystick of claim 11 wherein said resilient force means is a conical spring.

* * * * *